US012320586B2

(12) United States Patent
Le Bot et al.

(10) Patent No.: US 12,320,586 B2
(45) Date of Patent: Jun. 3, 2025

(54) FACILITY AND METHOD FOR HYDROGEN REFRIGERATION

(71) Applicant: L'Air Liquide, Societe Anonyme pour l'Etude et l'Exploitation des Procedes Georges Claude, Paris (FR)

(72) Inventors: Patrick Le Bot, Les Loges-en-Josas (FR); Marine Andrich, Les Loges-en-Josas (FR); Nicolas Kofman, Les Loges-en-Josas (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 313 days.

(21) Appl. No.: 17/914,294

(22) PCT Filed: Mar. 3, 2021

(86) PCT No.: PCT/EP2021/055376
§ 371 (c)(1),
(2) Date: Sep. 23, 2022

(87) PCT Pub. No.: WO2021/190892
PCT Pub. Date: Sep. 30, 2021

(65) Prior Publication Data

US 2023/0119575 A1 Apr. 20, 2023

(30) Foreign Application Priority Data

Mar. 23, 2020 (FR) ..... 2002797

(51) Int. Cl.
*F25J 1/00* (2006.01)
*F25J 1/02* (2006.01)

(52) U.S. Cl.
CPC ..... *F25J 1/001* (2013.01); *F25J 1/0037* (2013.01); *F25J 1/0045* (2013.01); *F25J 1/005* (2013.01); *F25J 1/0279* (2013.01); *F25J 2205/60* (2013.01); *F25J 2220/02* (2013.01); *F25J 2230/04* (2013.01)

(58) Field of Classification Search
None
See application file for complete search history.

(56) References Cited

U.S. PATENT DOCUMENTS

| | | | | |
|---|---|---|---|---|
| 3,401,111 | A | 9/1968 | Jackson | |
| 3,992,167 | A * | 11/1976 | Beddome | F25J 1/025 505/895 |
| 5,579,655 | A * | 12/1996 | Grenier | F25J 1/005 62/913 |
| 11,391,511 | B1 * | 7/2022 | Thomas | F25J 1/004 |
| 2010/0272634 | A1 * | 10/2010 | Schwartz | C01B 3/0089 422/187 |
| 2016/0222970 | A1 | 8/2016 | Becker et al. | |
| 2018/0347891 | A1 * | 12/2018 | Lundqvist | B60N 3/104 |
| 2018/0347897 | A1 * | 12/2018 | Cardella | F25J 1/0067 |
| 2023/0119575 | A1 * | 4/2023 | Le Bot | F25B 9/06 62/606 |
| 2024/0393041 | A1 * | 11/2024 | Gaertner | F25J 1/0215 |

FOREIGN PATENT DOCUMENTS

| | | | |
|---|---|---|---|
| JP | H0275882 | 3/1990 | |
| WO | WO-2018115684 A1 * | 6/2018 | F25J 1/0022 |

OTHER PUBLICATIONS

WO-2018115684-A1 English machine translation (Year: 2018).*
International Search Report and Written Report for PCT/EP2021/055376, mailed May 6, 2021.

* cited by examiner

*Primary Examiner* — Jenna M Maroney
(74) *Attorney, Agent, or Firm* — Justin K. Murray

(57) ABSTRACT

Facility and method for hydrogen refrigeration, comprising a hydrogen circuit to be cooled, comprising:—a first and a second set of heat exchanger(s) arranged in series for exchanging heat with the hydrogen circuit to be cooled;—a first cooling device for exchanging heat with the first set of heat exchanger(s) comprising a refrigerator that operates a refrigeration cycle of a first cycle gas;—a second cooling device for exchanging heat with the second set of heat exchanger(s) comprising a refrigerator that operates a refrigeration cycle of a second cycle gas having a molar mass of less than 3 g/mol, the refrigerator of the second cooling device comprising, arranged in series in a cycle circuit: at least one centrifugal compressor, a cooling member, an expansion member and a member for reheating the second expanded cycle gas;—a system for mixing at least one additional component having a molar mass greater than 50 g/mol with the second cycle gas before it enters the at least one centrifugal compressor and a member for purifying the mixture at the outlet of the at least one compressor configured to remove the at least one additional component up to a determined residual content and located upstream of the first set of heat exchanger(s).

24 Claims, 2 Drawing Sheets

[FIG.1]
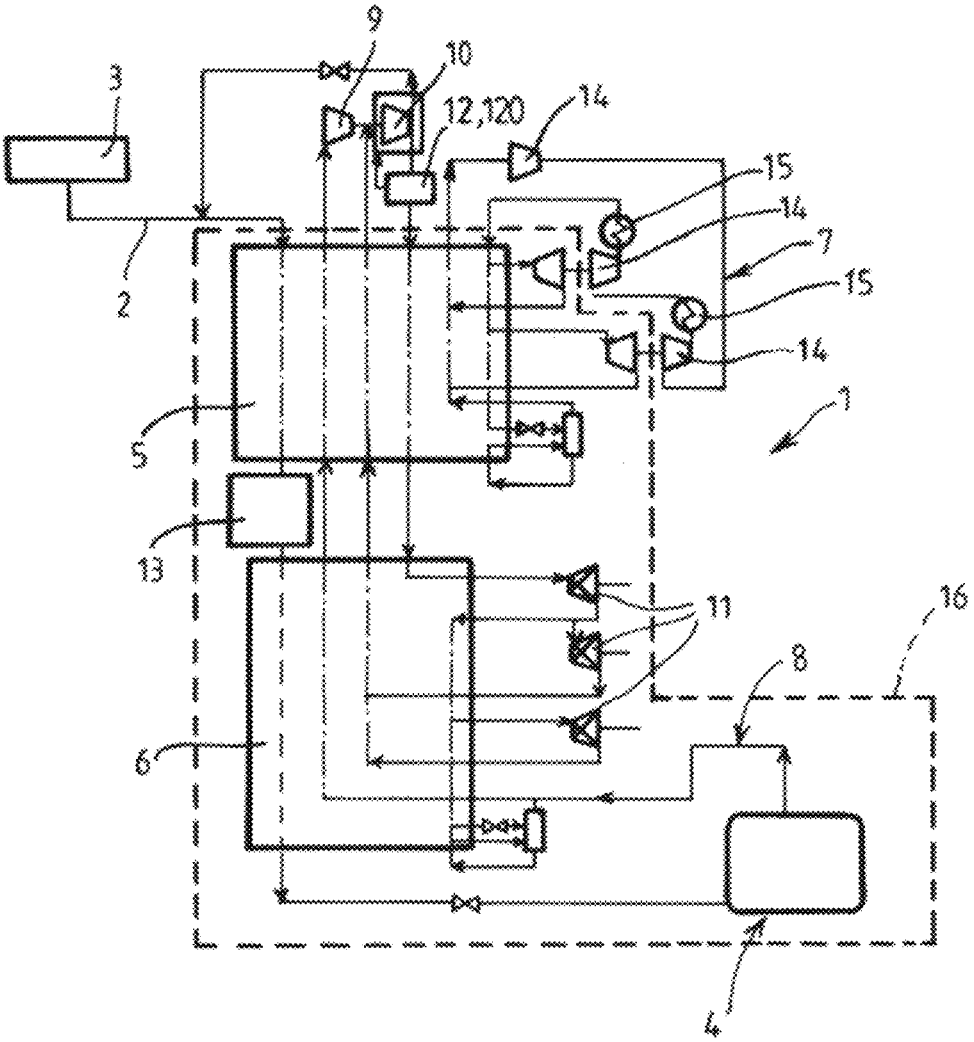
[FIG.2]
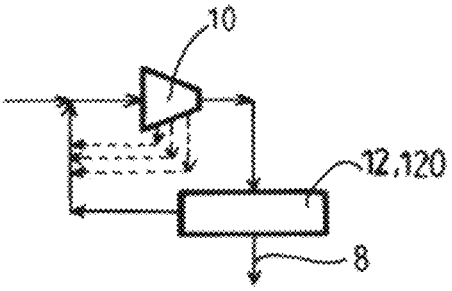

[FIG.3]
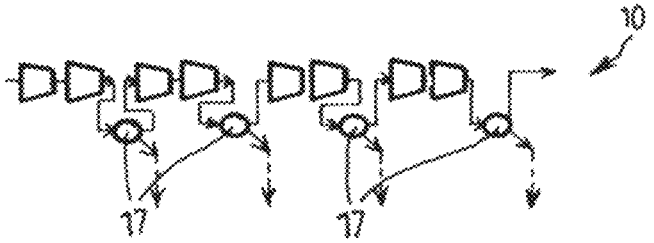
[FIG.4]
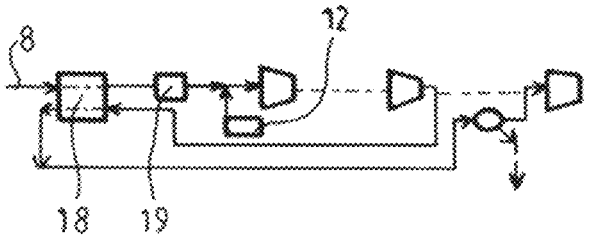

FACILITY AND METHOD FOR HYDROGEN REFRIGERATION

CROSS-REFERENCE TO RELATED APPLICATIONS

This application is a § 371 of International PCT Application PCT/EP2021/055376, filed Mar. 3, 2021, which claims § 119(a) foreign priority to French patent application FR 2002797, filed Mar. 23, 2020.

BACKGROUND

Field of the Invention

The invention relates to a plant and a process for the refrigeration of hydrogen.

The invention relates more particularly to a plant for the refrigeration of hydrogen at cryogenic temperature and in particular for the liquefaction of hydrogen, comprising a circuit of hydrogen to be cooled comprising an upstream end intended to be connected to a source of hydrogen and a downstream end connected to a member for collecting the cooled hydrogen, the cooling plant comprising a first set of heat exchanger(s) and a second set of heat exchanger(s) arranged in series in heat exchange with the circuit of hydrogen to be cooled, the plant for refrigeration a first cooling device in heat exchange with the first set of heat exchanger(s), the first cooling device comprising a refrigerator with a cycle of refrigeration of a first cycle gas, such as nitrogen, the cooling plant comprising a second cooling device in heat exchange with the second set of heat exchanger(s), the second cooling device comprising a refrigerator with a cycle of refrigeration of a second cycle gas having a molar mass lower than 3 g/mol, in particular hydrogen, in which the refrigerator of the second cooling device comprises, arranged in series in a cycle circuit: a member for compressing the second cycle gas, a member for cooling the second cycle gas, a member for expanding the second cycle gas and a member for reheating the expanded second cycle gas, the member for compressing the second cycle gas comprising at least one centrifugal compressor.

Related Art

The development of hydrogen fuel for mobile purposes will require large hydrogen liquefaction capacities with a view to logistics in liquid form of the product.

Known hydrogen liquefaction processes generally employ several refrigeration cycles in series. To achieve the very cold temperatures required for hydrogen liquefaction, a low-boiling-point compound or mixture of compounds is used in the final refrigeration cycle. Typically these compounds are $H_2$, He or Ne.

To bring the refrigeration fluid to the high cycle pressure, compression means are necessary. In order to maintain a good efficiency of liquefaction of the hydrogen, for example of less than 10 ~~kW.h/kg~~ kW·h/kg, the isothermal efficiency of the refrigerant compressor must remain high, of the order of 70% or more. Such efficiencies cannot be achieved by screw compressors. Only reciprocating compressor or centrifugal compression technologies can meet this need.

As the piston compression technology is volumetric, it is impossible to treat large volume flows. The use of such compressors for high-capacity hydrogen liquefiers (for example greater than 30 tonnes per day) requires the use of several compressors of this type.

Centrifugal compressors, for their part, can handle the large cycle flows required for high-capacity liquefiers. However, the low molecular weight of the constituents to be compressed is an obstacle to the use of a limited number of compression wheels. The refrigerant will thus be chosen so that its molecular weight is: low enough not to bring a phase of solidification at the operating temperatures and high enough to make possible centrifugal compression in a limited number of compression stages.

According to some studies, there is recommended a refrigerant consisting of a mixture of 75% helium and 25% neon, the molar mass of such a mixture being 8 g/mol, and a centrifugal compressor comprising six compression stages, each comprising between three and five wheels.

The document U.S. Pat. No. 3,992,167 describes a hydrogen refrigeration/liquefaction process which uses a refrigeration cycle and nitrogen precooling. This document describes the use of a heavy component (propane) mixed with the hydrogen before its centrifugal compression. According to this document, the addition of this constituent is limited because the revaporization of it in the hot part of the exchange line of the liquefaction cycle creates temperature differences (and thus irreversibilities and losses of efficiency). This solution thus does not make it possible to achieve higher compression pressures by increasing the fraction of propane injected. This device does not make it possible to achieve high pressures (25 bar or more) except by providing a number of compression wheels which is too great to be industrially and economically viable.

The heavy component mixed with the hydrogen must be removed in order to achieve a very low content (of the order of a ppm, for example). According to this solution, this purification is carried out in the cold box (between 140 and 80K). However, it is advisable not to freeze the component and thus to remain above its solidification point while purifying the hydrogen as much as possible in its cooling cycle. This requires a large temperature difference between the boiling point and the solidification point of the compound, which restricts the choice of the compound.

These constraints make this solution not very appropriate in terms of effectiveness for achieving high cycle pressures.

SUMMARY OF THE INVENTION

One aim of the present invention is to overcome all or some of the disadvantages of the prior art set out above.

To this end, the plant according to the invention, moreover in accordance with the generic definition given of it by the preamble above, is essentially characterized in that it comprises a system for mixing at least one additional constituent having a molar mass of greater than 50 g/mol with the second cycle gas before it enters the at least one centrifugal compressor and a member for purification of the mixture at the outlet of the compression member configured in order to remove the at least one additional constituent down to a predetermined residual content, the purification member being located upstream of the first set of heat exchanger(s).

Furthermore, embodiments of the invention can comprise one or more of the following characteristics:

- the predetermined residual content is less than 100 ppm and preferably less than 10 ppm, indeed even less than one ppm,
- the centrifugal compressor comprises a number of compressor wheels of between four and twelve, for example ten or eight wheels, the centrifugal compressor is of the multi-integrated type, the at least one additional constituent comprises at least one from: an alkane comprising at least four carbon atoms, a haloalkane comprising at most four carbon atoms, an unsaturated hydrocarbon comprising at least five carbon atoms, a halogenated unsaturated hydrocarbon comprising at most five carbon atoms, an ether having saturated or unsaturated radicals, comprising at least four carbon atoms, a haloether, having saturated or unsaturated radicals, comprising at most four carbon atoms, the refrigerator of the first cooling device comprises, arranged in series in a cycle circuit: a member for compressing the first cycle gas, a member for cooling the first cycle gas, a member for expanding the cycle gas and a member for reheating the expanded first cycle gas, the member for compressing the first cycle gas comprises at least one centrifugal compressor, the plant comprises a thermally insulated cold box harboring the cold-temperature components of the plant and in particular the first set of heat exchanger(s) and a second set of heat exchanger(s) arranged, and the system for mixing an additional constituent and the purification member are located outside the cold box, the circuit of hydrogen to be cooled comprises a cryogenic purification member configured to purify the hydrogen, such as a cryogenic adsorber.

The invention also relates to a process for the refrigeration of hydrogen at cryogenic temperature and in particular for its liquefaction, by means of a cooling plant comprising a circuit of hydrogen to be cooled comprising an upstream end connected to a source of hydrogen and a downstream end connected to a member for collecting the cooled hydrogen, the cooling plant comprising a first set of heat exchanger(s) and a second set of heat exchanger(s) arranged in series in heat exchange with the circuit of hydrogen to be cooled, the cooling plant comprising a first cooling device in heat exchange with the first set of heat exchanger(s), the first cooling device comprising a refrigerator with a cycle of refrigeration of a first cycle gas, such as nitrogen, the cooling plant comprising a second cooling device in heat exchange with the second set of heat exchanger(s), the second cooling device comprising a refrigerator with a cycle of refrigeration of a second cycle gas having a molar mass lower than 3 g/mol, in particular hydrogen, in which the refrigerator of the second cooling device subjects the second cycle gas to a thermodynamic cycle comprising a compression, a cooling, an expansion and a reheating, in which the compression is carried out by at least one centrifugal compressor and in which the second cycle gas is mixed with at least one additional constituent having a molar mass of greater than 50 g/mol before centrifugal compression and the gas mixture at the outlet of the centrifugal compression is purified of the additional constituent down to a predetermined residual content.

According to other distinctive features:

the predetermined residual content is less than 100 ppm and preferably less than 10 ppm, indeed even less than one ppm, the centrifugal compression uses a non-zero number of compression wheels less than or equal to twelve, preferably less than or equal to ten, for example less than or equal to eight, the centrifugal compression produces a compression ratio of the mixture of greater than five and preferably of between 6 and 15, at the outlet of the centrifugal compression, the pressure of the mixture is greater than 25 bar absolute and preferably between 25 and 90 bar, the purification of the gas mixture, at the outlet of the compression, of its additional constituent is carried out in a portion of the circuit in which the gas has a temperature of between −5° C. and 40° C., the process comprises a step of reheating the second cycle gas before mixing it with the at least one additional constituent for the purpose of vaporizing the latter.

The invention can also relate to any alternative device or process comprising any combination of the characteristics above or below within the scope of the claims.

BRIEF DESCRIPTION OF THE FIGURES

Other distinctive features and advantages will become apparent on reading the description below, made with reference to the figures, in which:

FIG. 1 represents a diagrammatic and partial view illustrating an example of structure and operation of a hydrogen refrigeration/liquefaction plant according to the invention, FIG. 2 represents a diagrammatic and partial view of a detail of the plant of FIG. 1, FIG. 3 represents a diagrammatic and partial view of a possible implementational example of the compression member of FIG. 2, FIG. 4 represents a diagrammatic and partial view of another possible implementational example of the compression member.

DETAILED DESCRIPTION OF THE INVENTION

The plant 1 for refrigerating hydrogen at cryogenic temperature, in particular configured for the liquefaction of hydrogen, comprises a circuit 2 of hydrogen to be cooled (liquefied) comprising an upstream end intended to be connected to a source 3 of hydrogen and a downstream end 4 connected to a member for collecting the cooled hydrogen.

For example, the source 3 of hydrogen comprises a unit of steam methane reforming (SMR) type and/or an electrolyser.

This source 3 provides, for example, hydrogen with a purity of greater than 99.9%, it being possible for the impurities contained to be, for example, CO, $N_2$, $CH_4$, $O_2$, Ar, $H_2O$, He or $NH_3$, according to the production methods, at a temperature of between 15° C. and 50° C. and a pressure of the order of 25 bar.

The plant 1 comprises a first set of heat exchanger(s) 5 for precooling the hydrogen stream to be cooled. A first cooling device 7 is in heat exchange with the first set of heat exchanger(s) 5 in order to provide cold intended to cool the hydrogen stream to a first temperature, for example of between 140 and 80K.

This first nitrogen cycle can thus cool the product to be liquefied down to the vaporization temperature of liquid nitrogen at 1.5 bar, thus in the vicinity of 80K.

The first cooling device 7 comprises a refrigerator with a cycle of refrigeration of a first cycle gas, such as nitrogen. As represented diagrammatically, this refrigerator of the first cooling device 7 comprises, arranged in series in a cycle circuit: a member 14 for compressing (one or more compressors) the first cycle gas, at least one member 5, 15 for cooling the first compressed cycle gas, a member 11 for expanding the cycle gas (one or more turbines or expansion valve) and a member 6 for reheating the first expanded cycle gas (the reheating before the return to the compression member 14 can thus be provided by the first set of exchanger(s) 5 countercurrentwise to the hydrogen stream which is precooled therein).

The plant 1 comprises a second set of heat exchanger(s) 6 for cooling the precooled hydrogen stream. A second cooling device 8 is in heat exchange with the second set of heat exchanger(s) 6 in order to provide cold intended to further lower the temperature of the hydrogen stream to a second temperature, for example of between 80 and 20K.

As illustrated, between the first 5 and the second 6 set of exchanger(s), the hydrogen circuit 2 can comprise a cryogenic purification member 13, such as a cryogenic adsorber (TSA or other), configured to purify the hydrogen and to free it from impurities, such as $N_2$ or CO, for example, which might freeze in the cold part of the hydrogen liquefaction exchanger.

The second cooling device 8 comprises a refrigerator with a cycle of refrigeration of a second cycle gas having a molar mass of less than 3 g/mol, in particular hydrogen.

This refrigerator of the second cooling device 8 comprises, arranged in series in a cycle circuit: a member 9, 10 for compressing the second cycle gas, a member 5 for cooling the second cycle gas, a member 11 (one or more turbines or expansion valves in series and/or parallel) for expanding the second cycle gas and a member 6 for reheating the expanded second cycle gas. The reheating before the return to the compression member 9, 10 can thus be provided by the second set of exchanger(s) 6 countercurrentwise to the hydrogen stream which is cooled therein.

The member 9, 10 for compressing the second cycle gas comprises at least one centrifugal compressor and a system 120 for injection and mixing of an additional constituent having a molar mass of greater than 50 g/mol with the second cycle gas before it enters the at least one centrifugal compressor and a member 12 for purifying the mixture at the outlet of the compression member 9, 10 configured to remove the additional constituent down to a predetermined residual content.

The at least one additional constituent comprises for example at least one from: the at least one additional constituent comprises at least one from: an alkane comprising at least four carbon atoms, a haloalkane comprising at most four carbon atoms, an unsaturated hydrocarbon comprising at least five carbon atoms, a halogenated unsaturated hydrocarbon comprising at most five carbon atoms, an ether having saturated or unsaturated radicals, comprising at least four carbon atoms, a haloether, having saturated or unsaturated radicals, comprising at most four carbon atoms.

The purification member 12 is located upstream of the first set of heat exchanger(s) 5, that is to say in the relatively warm noncryogenic part (that is to say operating at a temperature of greater than −150° C. and in particular of greater than −50° C.) of the plant 1. For example, the purification member 12 is configured in order to operate and to treat the gas to be purified at a temperature of greater than −10° C., preferably of greater than 0° C., indeed even of greater than 5° C. and in particular at ambient temperature.

For the sake of simplicity, the mixing system 120 which injects the additional constituent and the purification member 12 have been illustrated diagrammatically within one and the same physical entity. However, this is in no way limiting (at least two distinct respective entities might be provided). For example, at the inlet of the compression member 10, the additional constituent supplied by an outlet of the purification member 12 is added to the pure hydrogen of the cycle having a pressure, for example, of the order of 6 bar.

As illustrated, the additional constituent can be added to the pure hydrogen of the cycle between two compression stages 9, 10 (and/or upstream of the first compression stage).

The purification member 12 can comprise, for example, a pressure swing adsorption (PSA) and/or temperature swing adsorption (TSA) system comprising at least two adsorbers, for example three adsorbers. The adsorbent material employed can be chosen, without this being limiting, from: the family of zeolites, activated carbons, activated aluminas or silica gels. The purification cycle is preferably configured in order to obtain recovery yields for the hydrogen and the additional component of greater than 80%, preferably of greater than 90%, more preferably of greater than 95% or more advantageously still of greater than 99%.

It should be noted that the purification member 12 can optionally comprise a partial condensation device with, for example, a refrigeration unit (operating, for example, down to −50° C. or −40° C. or −30° C. approximately) and located upstream of the purifier of PSA or TSA type which can operate it, for example, at a higher temperature, in particular of greater than 0° C., of greater than 5° C. or of greater than 10° C.

The purification cycle can make it possible to recover all of the additional component, without loss of hydrogen. The predetermined residual content is preferably less than 100 ppm and preferably less than 10 ppm or even less than one ppm.

At the outlet of the purification member 12, the compressed and purified hydrogen can have a pressure, for example, of greater than 25 bar absolute and preferably of the order of 50 to 60 bar (compression ratio, for example, of greater than five and preferably of greater than eight).

Preferably, the centrifugal compressor 10 has a number of compression wheels of less than or equal to twelve, preferentially of less than or equal to ten, indeed even eight. This is because such a number of compression wheels preferably makes possible the use of a multi-integrated centrifugal compressor ("gear-type" compressor). This configuration makes it possible to vary the speed of rotation of the compression wheels every two stages, which is very favorable for the compression of a light gas. FIG. 3 represents a possible implementational example of the centrifugal compression member 10 with eight compression wheels. A system 17 for refrigeration (with optional condensation of the added heavy component) of the gas can be provided between each stage (or alternately at the outlet of each pair of wheels, as illustrated).

It should be noted that, during the mixing of the additional constituent with the hydrogen at the inlet of the centrifugal compression member 10, this constituent, which can be in liquid form, is liable to be vaporized at least in part by direct contact with the hydrogen. The temperature of the mixture obtained (gas or two-phase) is colder than that of the hydrogen before mixing. For a more extensive partial or total vaporization of this heavier constituent in the hydrogen, it is possible to envisage preheating the hydrogen upstream, for example by heat exchange in a heat exchanger 18 which recovers compression heat downstream of one of the compression wheels and/or heat supplied by another source 19 of external heat (cf. FIG. 4).

The plant 1 thus makes possible at any one time a centrifugal compression making it possible to treat high cycle flow rates (suitable for a high-capacity hydrogen liquefier) while requiring a limited number of compression wheels.

Thus, the plant makes it possible to provide a relatively high pressure in the cycle of the hydrogen refrigerator, while retaining, indeed even reducing, the number of compression stages compared to the prior art.

Preferably, the compressor(s) 14 of the refrigeration cycle of the first cooling device 7 are also compressors of centrifugal type and more preferentially still of multi-integrated type.

Preferably, all the compressors used in the refrigeration cycles are of centrifugal type and more preferentially still of multi-integrated type, and have less than 12, indeed even 10, indeed even 8, compression wheels.

As the circuit of the refrigerator of the second cooling device 8 can be fed with second cycle gas (hydrogen) originating from the member (storage or other) receiving the liquefied gas at the downstream end 4 of the circuit 2 of hydrogen to be liquefied. This can be achieved via at least one pipe which sends this gas back to the inlet of the compression while passing through the sets of heat exchanger(s) 5, 6. Moreover, as illustrated, a part of the compressed gas at the outlet of the compression member 9, 10 (before and/or after purification 12) can be diverted to the upstream part of the circuit 2 of hydrogen to be liquefied (upstream of the first set 5 of heat exchanger(s)). That is to say that the circuit of the refrigerator of the second cooling device 8 can be an open-loop cycle.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A plant for the refrigeration and liquefaction of hydrogen at cryogenic temperature, the plant comprising:

a circuit of hydrogen to be cooled comprising an upstream end intended to be connected to a source of hydrogen and a downstream end connected to a cryogenic storage vessel configured to collect the cooled hydrogen;

a first set of heat exchangers and a second set of heat exchangers arranged in series in heat exchange with the circuit of hydrogen to be cooled;

a first cooling device in heat exchange with the first set of heat exchangers, the first cooling device comprising a refrigerator with a cycle of refrigeration of a first cycle gas;

a second cooling device in heat exchange with the second set of heat exchangers, the second cooling device comprising a refrigerator with a cycle of refrigeration of a second cycle gas having a molar mass lower than 3 g/mol, the refrigerator of the second cooling device comprising, arranged in series in a cycle circuit: a member for compressing the second cycle gas, a heat exchanger for cooling the second cycle gas, one or more turbines or expansion valves in series and/or parallel for expanding the second cycle gas, and a member for reheating the expanded second cycle gas, the member for reheating the expanded second cycle gas being the second set of heat exchangers, the member for compressing the second cycle gas comprising at least one centrifugal compressor;

a system for injection of at least one additional constituent having a molar mass of greater than 50 g/mol into the second cycle gas and mixing therewith before the second cycle gas enters the at least one centrifugal compressor;

a member for purification of the mixture at the outlet of the compression member configured in order to remove the at least one additional constituent down to a predetermined residual content, the purification member being located upstream of the first set of heat exchangers and being configured to remove the at least additional constituent down to a residual content of less than 100 ppm upstream of the first set of heat exchangers, the purification member being a pressure swing adsorption (PSA) and/or temperature swing adsorption (TSA) system comprising at least two adsorbers; and a thermally insulated cold box harboring the first set of heat exchangers and the second set of heat exchangers, wherein the system for injecting and mixing an additional constituent and the purification member are located outside the thermally insulated cold box.

2. The plant of claim 1, wherein the predetermined residual content is less than 10 ppm.

3. The plant of claim 1, wherein the predetermined residual content is less than one ppm.

4. The plant of claim 3, wherein the purification member is noncryogenic and configured in order to treat the gas to be purified at a temperature of greater than −50° C. and the pressure swing adsorption (PSA) and/or temperature swing adsorption (TSA) system comprises two or three adsorbers.

5. The plant of claim 4, wherein each of the two or three adsorbers comprises at least one adsorbent material chosen from: zeolites, activated carbons, activated aluminas, and silica gels.

6. The plant of claim 1, wherein the centrifugal compressor comprises 4-12 compressor wheels.

7. The plant of claim 6, wherein the centrifugal compressor comprises ten or eight compressor wheels.

8. The plant of claim 6, wherein the centrifugal compressor is of the multi-integrated type.

9. The plant of claim 1, wherein the at least one additional constituent comprises at least one:

an alkane comprising at least four carbon atoms;

a haloalkane comprising at most four carbon atoms;

an unsaturated hydrocarbon comprising at least five carbon atoms;

a halogenated unsaturated hydrocarbon comprising at most five carbon atoms;

an ether having saturated or unsaturated radicals comprising at least four carbon atoms; and a haloether having saturated or unsaturated radicals and comprising at most four carbon atoms.

10. The plant of claim 1, wherein the refrigerator of the first cooling device comprises, arranged in series in a cycle circuit: at least one centrifugal compressor for compressing the first cycle gas, a member for cooling the first cycle gas, one or more turbines or expansion valves for expanding the cycle gas, and a member for reheating the expanded first cycle gas, the member for reheating the expanded first cycle gas being the first set of heat exchangers.

11. The plant of claim 1, wherein the circuit of hydrogen to be cooled comprises a cryogenic adsorber configured to purify the hydrogen.

12. The plant of claim 1, wherein the first cycle gas is nitrogen.

13. The plant of claim 1, wherein the second cycle gas is hydrogen.

14. A process for liquefaction of hydrogen using the cooling plant of claim 1, the process comprising the steps of:

providing the plant as claimed in claim 1;

using the refrigerator of the second cooling device to subject the second cycle gas to a thermodynamic cycle comprising a compression carried out by at least one centrifugal compressor, a cooling, an expansion and a reheating;

mixing the second cycle gas with at least one additional constituent having a molar mass of greater than 50 g/mol before centrifugal compression thereof to provide a gas mixture; and purifying, with the purification member, the gas mixture at the outlet of the centrifugal compression of the additional constituent down to a predetermined residual content of less than 100 ppm upstream of the first set of heat exchangers.

15. The process as claimed in claim 14, wherein the predetermined residual content is less than 10 ppm.

16. The process as claimed in claim 15, wherein the predetermined residual content is less than one ppm.

17. The process as claimed in claim 15, wherein the centrifugal compression uses a nonzero number of compression wheels less than or equal to twelve.

18. The process of claim 17, wherein the centrifugal compression produces a compression ratio of the mixture of greater than five.

19. The process of claim 14, wherein, at the outlet of the centrifugal compression, the pressure of the mixture is greater than 25 bar absolute.

20. The process of claim 19, wherein, at the outlet of the centrifugal compression, the pressure of the mixture is between 25 and 90 bar absolute.

21. The process of claim 14, wherein the purification of the gas mixture, at the outlet of the compression, of its additional constituent is carried out in a portion of the circuit in which the gas has a temperature of between −5° C. and 40° C.

22. The process of claim 14, further comprising a step of reheating the second cycle gas before mixing the second cycle gas with the at least one additional constituent for the purpose of vaporizing thereof.

23. The process of claim 14, wherein the first cycle gas is nitrogen.

24. The process of claim 14, wherein the second cycle gas is hydrogen.

* * * * *